United States Patent [19]

Snyder et al.

[11] Patent Number: 4,481,563

[45] Date of Patent: Nov. 6, 1984

[54] AUTOMOTIVE HEADLIGHT HAVING OPTICS IN THE REFLECTOR

[75] Inventors: Edward A. Snyder, Lindley; Michael P. Teter, Horseheads, both of N.Y.

[73] Assignee: Corning Glass Works, Corning, N.Y.

[21] Appl. No.: 376,511

[22] Filed: May 10, 1982

[51] Int. Cl.[3] ..... F21V 7/00

[52] U.S. Cl. ..... 362/296; 362/80; 362/83; 362/297; 362/346; 362/347; 350/600; 364/525

[58] Field of Search ..... 362/296, 297, 346, 347, 362/80, 83; 350/292, 293; 364/525

[56] References Cited

U.S. PATENT DOCUMENTS

| | | | |
|---|---|---|---|
| 153,341 | 7/1874 | Jacobsen . | |
| 1,142,268 | 7/1915 | MacLean . | |
| 1,346,268 | 7/1920 | Smith . | |
| 1,824,429 | 9/1931 | Goss . | |
| 1,863,547 | 6/1932 | Arbuckle . | |
| 1,923,181 | 8/1933 | Albers . | |
| 2,191,546 | 2/1940 | Schreiber . | |
| 2,220,145 | 11/1940 | Cooke . | |
| 2,501,140 | 3/1950 | Pique . | |
| 3,492,474 | 1/1970 | Yamaguchi et al. . | |
| 3,511,983 | 5/1970 | Dorman . | |
| 3,700,883 | 10/1972 | Donohue et al. | 240/41.36 |
| 3,710,095 | 1/1973 | Donohue et al. | 240/41.36 |
| 4,149,227 | 4/1979 | Dorman | 362/297 |
| 4,153,929 | 5/1979 | Laudenschlarger | 362/348 |
| 4,351,018 | 9/1982 | Fratty | 362/348 |

OTHER PUBLICATIONS

Donohue, et al., "Computer Design of Automotive Lamps W/Faceted Reflectors", Journal of IES/Oct. 72, pp. 36–42.

Lucas Electrical Limited, Publication No. 3995/RL-6, Issue 1, 1982.

*Primary Examiner*—Donald P. Walsh

*Attorney, Agent, or Firm*—B. R. Turner; R. E. Kurtz

[57] ABSTRACT

An automotive headlight has a clear unfluted front cover and a reflector which directs light from a source through the front cover in a desired pattern. The reflective surface is smooth and continuous formed of two edge ellipsoids and a center ellipsoid joined in smooth continuous junctions. The center ellipsoid is modified to include a smooth vertical bump and the ellipsoids are tilted off the axis of the headlight. The headlight is formed by a digital computer aided process which includes tracing the paths of a plurality of light rays emanating from a digitally modeled light source, intersecting a reflector modeled by digital shape functions and projected onto a sphere surrounding the reflector. The light intensity across a part of the sphere is compared with the prescribed automotive headlight specifications. The parameters of the shape functions are changed and the process is performed iteratively to produce a light intensity best matching the specifications.

22 Claims, 11 Drawing Figures

AUTOMOTIVE HEADLIGHT HAVING OPTICS IN THE REFLECTOR

BACKGROUND OF THE INVENTION

This invention relates to automotive headlights, and more particularly, to a headlight in which the reflector is contoured to meet the required light specifications and the lens is replaced with a clear cover plate which can be placed at any angle which is aerodynamically desirable.

Sealed beam automotive headlights include a paraboloidal reflector which collects light from an incandescent filament bulb and directs it toward a lens. The lens has flutes which shift and spread the light into a beam pattern which meets the specifications set by the Society of Automotive Engineers. Because the standard lens is the optically active element having fluting with flute risers and edges, its positioning with respect to the bulb and reflector is critical. Desirably the position of the lens should be nearly normal to the light emanating from the bulb and reflector, since riser glare becomes worse when the lens is slanted at an angle thereto. That is, the lens fluting produces uncontrolled light, known as glare, from the flute risers and edges. In many instances, it would be desirable to have a headlight with a slanted front surface which would give superior aerodynamic performance. However, as noted above, with the optics in the lens and the resulting glare, it is not practical to provide such a slanted front surface which also would be desirable for reasons of style. It is the elimination of this type of glare while retaining the benefits of slanted lenses which is an object of this invention.

U.S. Pat. Nos. 153,341—Jacobsen and 1,346,268—Goodley show early attempts to produce lamps with the optics in the reflectors. U.S. Pat. Nos 3,511,983—Dorman and 4,149,277—Dorman, show more recent attempts to provide a lamp in which the reflector produces a desired light pattern. These reflectors are not suitable for meeting the more stringent automotive specifications.

"Computer Design of Automotive Lamps With Faceted Reflectors", Donohue and Joseph, J. of I.E.S./1972, pp. 36–42 describes an automotive lamp in which the reflector is divided into segments (facets) in such a manner that the reflector alone produces the pattern and lens fluting is eliminated. The many facets, as shown in FIG. 12 of that article, have sharp edges and discontinuities between them. Since each facet is a paraboloidal surface, the intersections, or junctions, between the surfaces necessarily are not smooth. Because of this, the fabrication of such a reflector is quite difficult. These reflectors may be formed from any suitable material such as glass, plastic or metal. It is quite difficult to form the surfaces having the discontinuous junctions shown in FIG. 12 of that article.

It is an object of the present invention to provide an automotive headlight reflector which directs light in a pattern which meets automotive specifications and which has smooth, continuously joined surfaces which facilitate fabrication of the headlight.

SUMMARY OF THE INVENTION

In accordance with this invention, the reflector for a sealed beam headlight has reflector surfaces which direct light from the bulb through a clear, unfluted front cover in a pattern which meets the specification for automotive headlights. The reflective surface is smooth and continuous which makes the reflector easy to fabricate and eliminates undesirable reflector flute glare. Since there are no flutes, the cover may be aerodynamically swept, yeilding both styling and performance advantages upon which manufactureres now place a premium.

The headlight is produced by a digital computer aided process in which a digitally modeled reflective surface is modified in an iterative procedure to produce a light intensity pattern which best meets automotive specifications and wherein the reflective surface is smooth and continuous. A digitally modeled light source which closely approximates the light intensity from a tungsten halogen lamp is used. In the prior art, a plurality of parabolic reflectors made up the headlight. The prior art design processes merely determined where the light from each parabolic facet was directed and accordingly changed this direction to obtain the desired light pattern. In contrast, the present invention traces a very large number of ray paths, e.g., 500,000, from an accurately modeled distributed light source to the reflective surface. The ray paths are projected, from the normal to the reflective surface, onto a surface such as a sphere surrounding the reflector. Light intensity across a portion of the spherical surface is determined by counting the number of light rays intersecting each unit area. The intensity thus determined can be digitally compared to the S.A.E. specifications and a performance function, indicating the match with the specifications, is generated. The shape of the digitally modeled reflective surface is changed in an iterative procedure to optimize the performance function. At each change in the shape, the junctions between the surfaces are blended, or smoothed, so that there are no sharp edges, or discontinuities which makes fabrication difficult.

The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
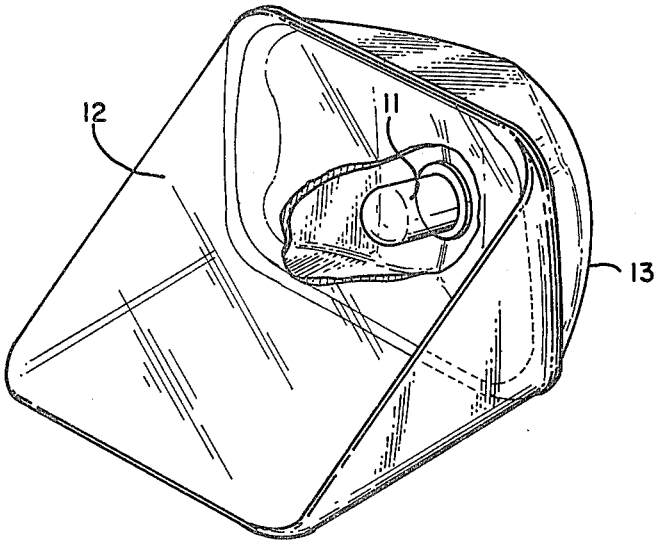
FIG. 1 is a side view of a reflector attached to a clear cover plate.

Referring to FIG. 1, the automotive headlight of this invention includes a bulb 11 having a filament to provide a light source and a clear front cover 12 which may be swept at an aerodynamically desired angle with respect to the headlight. As used herein, this means that the front cover is swept at an angle of at least 15° and preferably on the order of 45° to 50° as depicted in FIG. 1.

A reflector 13 encloses the bulb and is sealingly attached to the front cover 12. The reflector has a reflective surface which directs light from the bulb 11 through the front cover in a pattern which meets the specifications for automotive headlights.

As shown in FIGS. 2, and 2A–2C the reflector has reflective surfaces which include a center modified ellipsoid 14 and two edge modified ellipsoids 15 and 16. Edge ellipsoid 15 joins center ellipsoid 14 in a smooth, continuous junction 17; similarly, edge ellipsoid 16 joins center ellipsoid 14 in a smooth continuous junction 18.

The center surface 14 is an ellipsoid with a smooth vertical bump 21 added to the center. Ellipsoidal surface 14 is concave and is tilted off the axis of the headlight. Ellipsoids 14, 15 and 16 are concave and are modified from true parabolic surfaces in a manner which produces the presecribed light pattern, and which produces smooth, continuous junctions between the surfaces. A center platform 22 which may have sharp edges provided for attachment and alignment of the lamp, but it is not part of the reflecting surface. In accordance with the present invention, such sharp edges are avoided over substantially all of the reflective surface.

Figure 4:
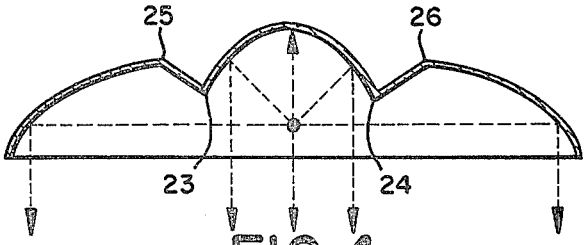
FIG. 4 PRIOR ART
FIG. 4 depicts a prior art reflector.
Figure 3:
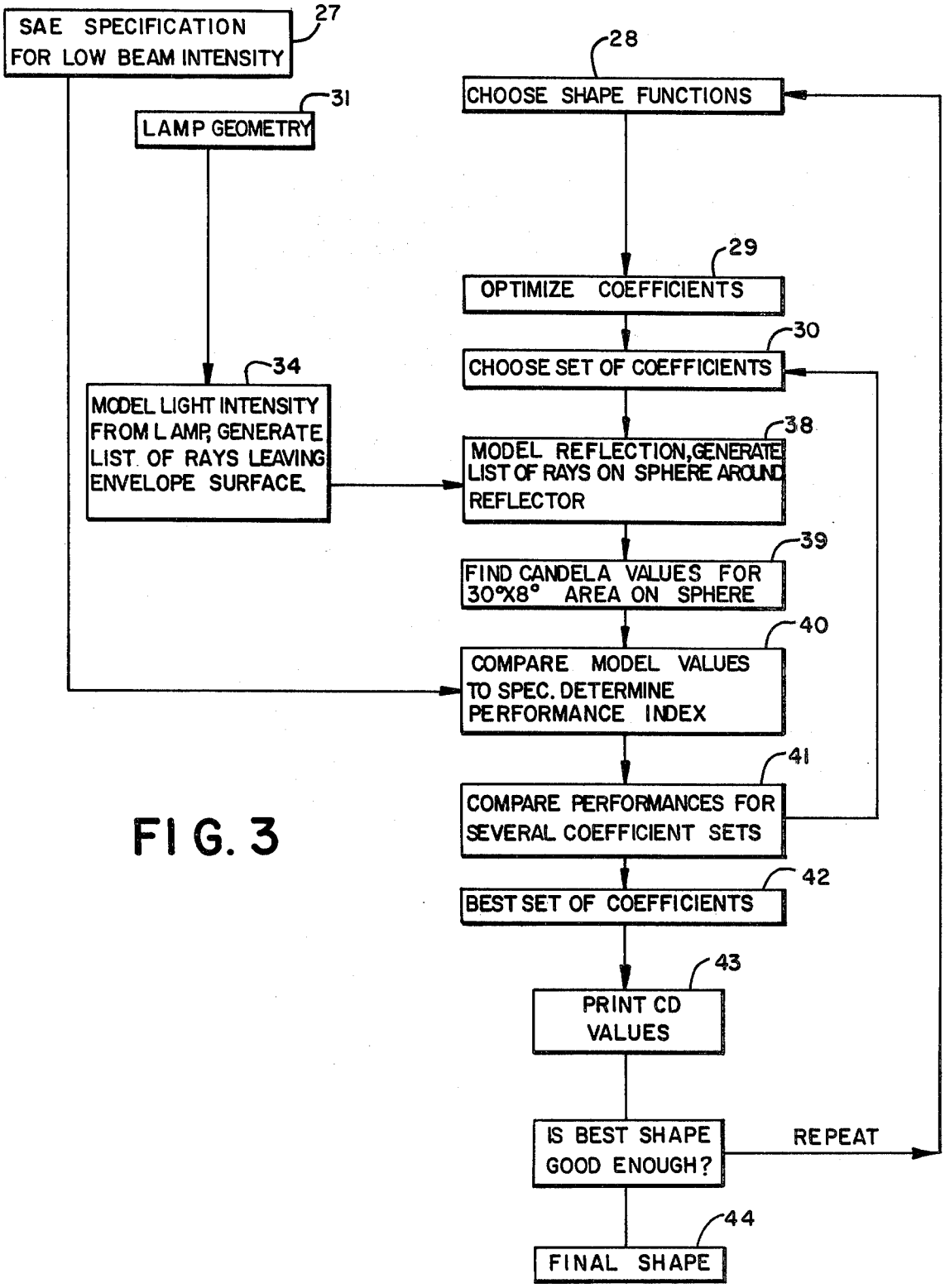
FIG. 3 is a flow chart depicting the computer aided process for producing the headlamp.

FIG. 3 depicts the computer aided process by which this type of reflector was produced. Before describing it, it is useful to refer to FIG. 4 which depicts a prior art reflector in a manner which shows the advantages of the present invention. FIG. 4 depicts a prior art attempt, known to the inventors, of reducing the depth of the reflector by using a plurality of parabolic surfaces instead of a single parabolic surface. Note that the intersections 23 and 24 between the parabolic surfaces present sharp edges which are not modeled and are difficult to fabricate. Furthermore, the portions of the reflector between 23 and 25 and between 24 and 26 are shadowed. They do not contribute to light reflection. The reflector of FIG. 4 does not have a normal vector at the junctions 23 and 24. Stated another way, the minimum radius of curvature is very small at 23 and 24. The surface slope is discontinuous, that is, the minimum radius of curvature is arbitrarily small. As used herein, smooth and continuous junctions means that the conditions depicted at 23 and 24 in FIG. 4 are not present, that the normal is always well defined.

Figure 2:
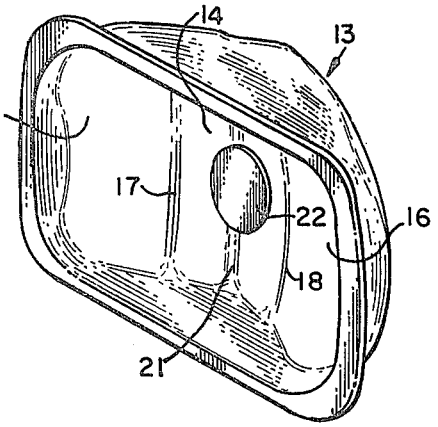
FIG. 2 is a perspective view of the reflector.
Figure 2A:
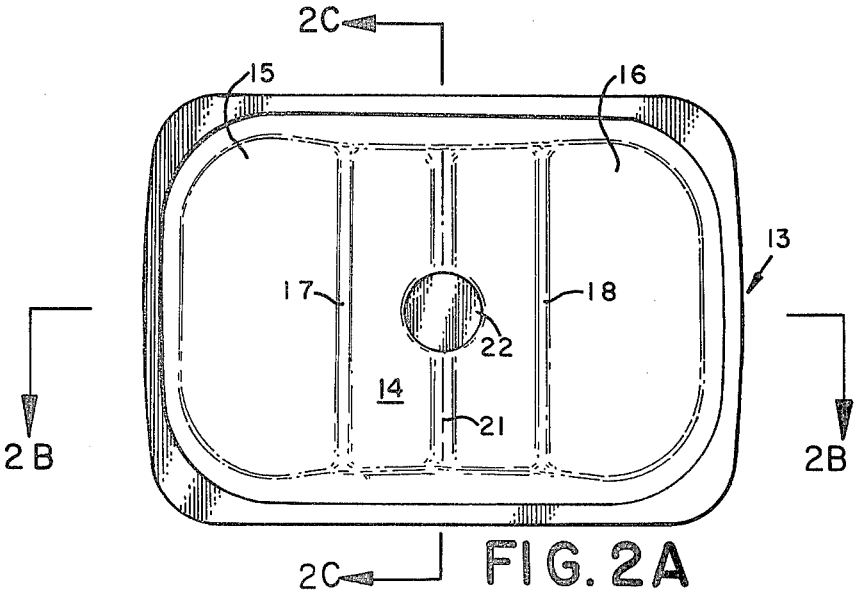
FIGS. 2A–2C are front, top sectional and side sectional views respectively of the reflector in accordance with the present invention.
Figure 2B:
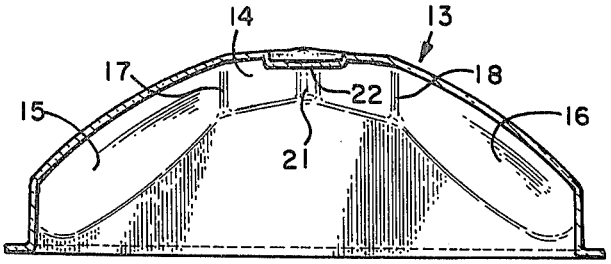
Figure 2C:
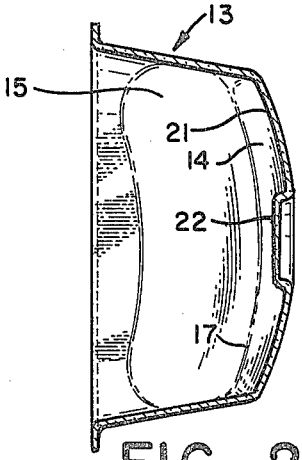

If, as in the reflector of FIG. 2, the shape involves separate reflector surfaces, junctions between surfaces are treated as any other reflecting area. Resulting intensity calculations include effects of the smooth junctions, so the junctions are made large enough to facilitate the glass forming process. Where the minimum radius of curvature is less than 0.050 there are increasing problems in forming glass to a sharp edge. The preferred embodiment of this invention has a minimum radius of curvature of 0.193 inch, but the invention can be practiced with surfaces having smooth junctions with a minimum radius of curvature greater than about 0.050 inch.

The prior art ignores reflections from the junction. These lamps have discontinuous reflective surfaces (such as the Donohue et al paper and FIG. 4 herein) or slope discontinuities at surface intersections (the Dorman patents).

Since the prior art does not deal with junctions, the junctions in an actual product must be kept as sharp as possible, i.e., the radius of curvature must be arbitrarily small. The reflector of the present invention has no such problems, since the shape is chosen to have a large minimum radius of curvature at the junctions.

Referring again to FIG. 3, the computer aided process of this invention includes digitizing the prescribed light pattern as an input to the digital computer, the step being indicated at 27. In the example being described, the SAE specifications are those set forth in Table I—Test Point Values for 7 in. (178 millimeter) Type 2 Seal Beam Units, listed in S.A.E. J. 5 79C, page 23.31 of Report of Lighting Division Approved, January 1940, and last revised by Lighting Committee, December 1974.

As indicated at 28, the parameters of a plurality of shape functions specifying the surface of a reflector are digitized and provided as an input to the digital computer. In the example under consideration, the shape functions are a center modified ellipsoid and two edge modified ellipsoids. The coefficients of these ellipsoids are the parameters which are modified to meet the light pattern specifications and to produce smooth, continuous junctions between the edges of the ellipsoids. The optimization of these coeffieicents is indicated at 29. This includes choosing a particular set of coefficients for the shape functions as indicated at 30, and using this reflector shape with a plurality of light paths to find the resulting light intensity distribution.

Figure 5:
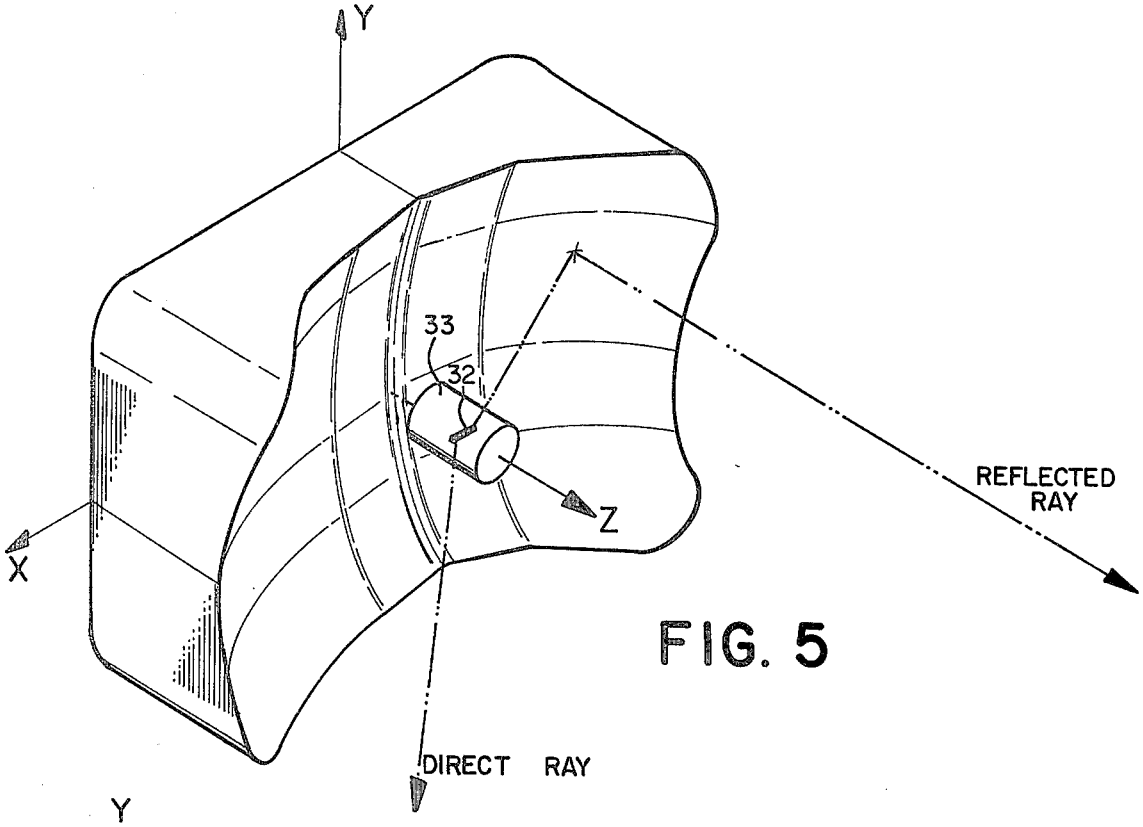
FIG. 5 depicts the digital computer generated model of the light source and reflecting surfaces.

The list of light rays are produced from a digital computer model of a tungsten halogen lamp, indicated at 31. Referring to FIG. 5, this model includes a transverse filament 32 with a temperature distribution along its length. That is, as is normal, filaments are cool at their ends and hotter in the middle. The resulting light rays are refracted through an envelope which is modeled as a quartz cylinder 33 with opaque end caps.

Figure 6:
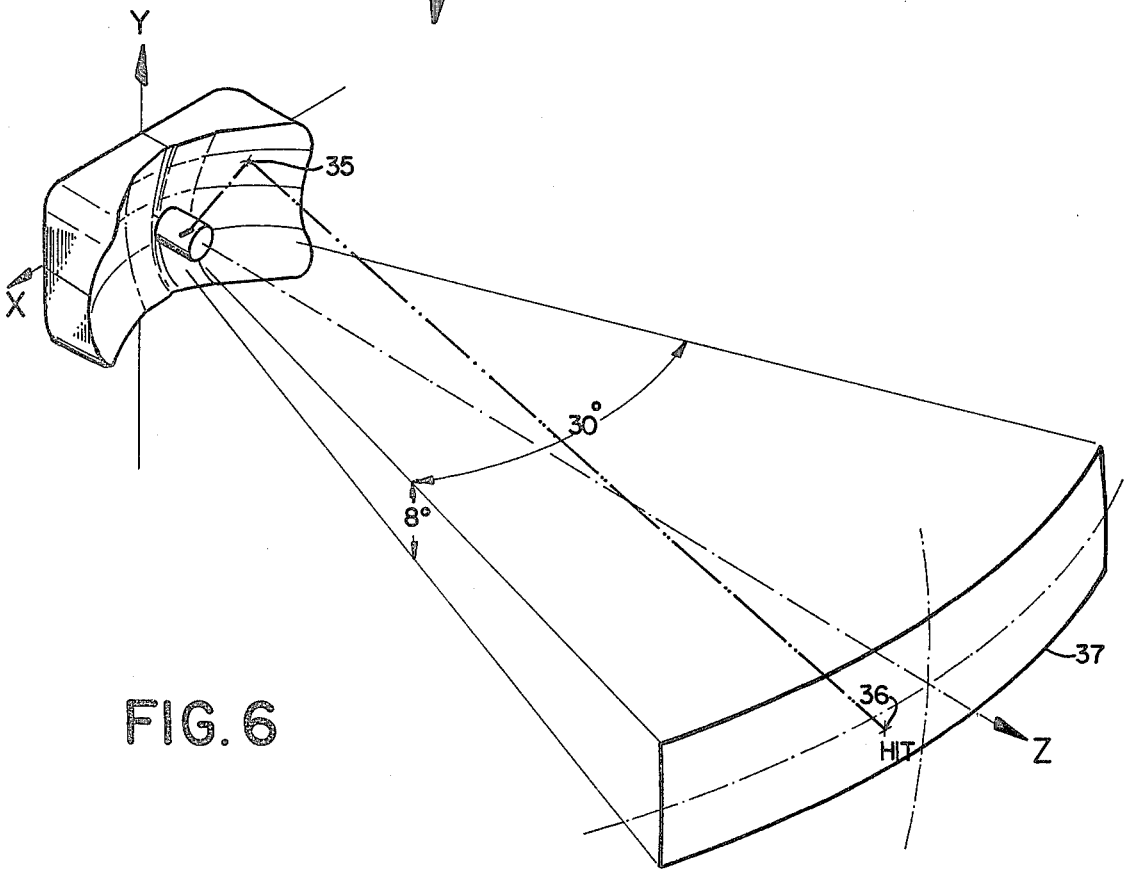
FIG. 6 is similar to FIG. 5 and additionally shows the intersection of the light rays with a surface of the sphere.

As indicated at 34 in FIG. 3, the light intensity from this digital model lamp is generated by a list of ray paths leaving the envelope surface. A ray from the envelope is tested to determine whether it intersects the reflector. If it does not, it is projected directly onto a sphere surrounding the reflector. If a ray path does intersect, as at the point 35 in FIG. 6, it is projected onto the surface of the sphere surrounding the reflector. For example, the ray path which is reflected at 35, intersects the sphere at the point 36. Actual intensities are determined only for a 30° by 8° screen on the sphere, the screen being indicated at 37 in FIG. 6. Intensities are determined by counting the number of rays per unit area to hit the sphere.

Referring again to FIG. 3, the step 38 depicts the model of the reflection and the generation of the list of rays on the sphere around the reflector. In order to specify the ray path of the reflected ray, the theoretical surface normal at the point of intersection with the reflector (e.g. the point 35 in FIG. 6) is found. The description of the reflector, from the digital computer steps 28, 29 and 30, is used to find the normal at the point of intersection. Any real reflector is distorted from the theoretical shape by forming inaccuracies. This distortion is modeled in accordance with the present invention by allowing the surface normal to vary about the theoretical normal. A value of $2\sigma=1°$ was chosen for use in this model by matching actual measurements to model predictions on a previous design. The reflected ray is finally calculated using this distorted normal and the incident ray.

From the ray path tracing, the light intensity across a surface of the sphere is determined as indicated at 39. This is done by counting the number of ray paths intersecting each unit area on the sphere screen. These values are compared to the prescribed light pattern as indicated at 40. For each shape which are tried, a performance factor, referred to as PFUN, is determined. The performance factor is a measure of how the light intensity pattern for the shape being tested matches the S.A.E. specifications.

Steps 30, 38, 39 and 40 are repeated for different shapes, that is for different surface coefficients. As indicated at 41, the shape which produces a light intensity best matching the prescribed light pattern is determined. This is done by choosing the set of coefficients having the optimum performance function, in this case the minimum value of PFUN. This results in the selection of the best set of coefficients as indicated at 42.

For this set of coefficients, the candela values at each of a plurality of points are printed out as indicated at 43. Appendix II lists a typical printout. The printout lists candela values at 60 feet for each of 26 test points corresponding with the S.A.E. test points. Note that of the 26 test points, only test point 25 has a value, 7.71, that is out of spec. In the present case a reflector surface has been produced which substantially meets S.A.E. specifications.

From the printout produced at 43 in FIG. 3, the designer may determine that a better light intensity distribution pattern must be produced. The computer program to be subsequently described has the capability of repeating the process for different shape functions which the designer may choose. The designer also may choose which coefficients are varied in the process.

From the iterative operation of this process, the best shape is selected as indicated at 44 in FIG. 3. This shape is used in the fabrication of reflectors.

Figure 7:
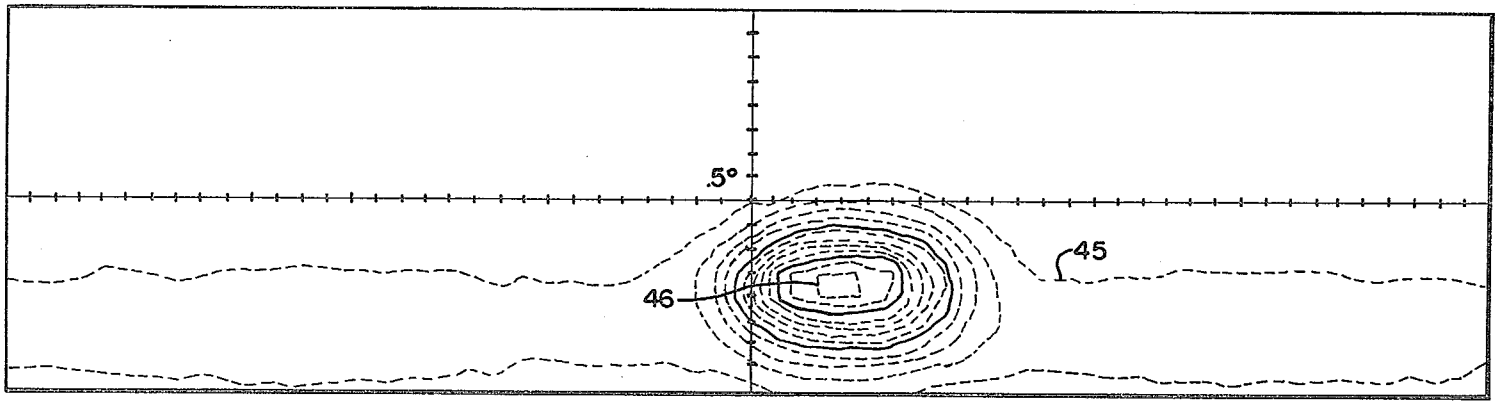
FIG. 7 is a candela diagram of a low beam pattern produced by a reflector in accordance with the present invention.
Figure 8:
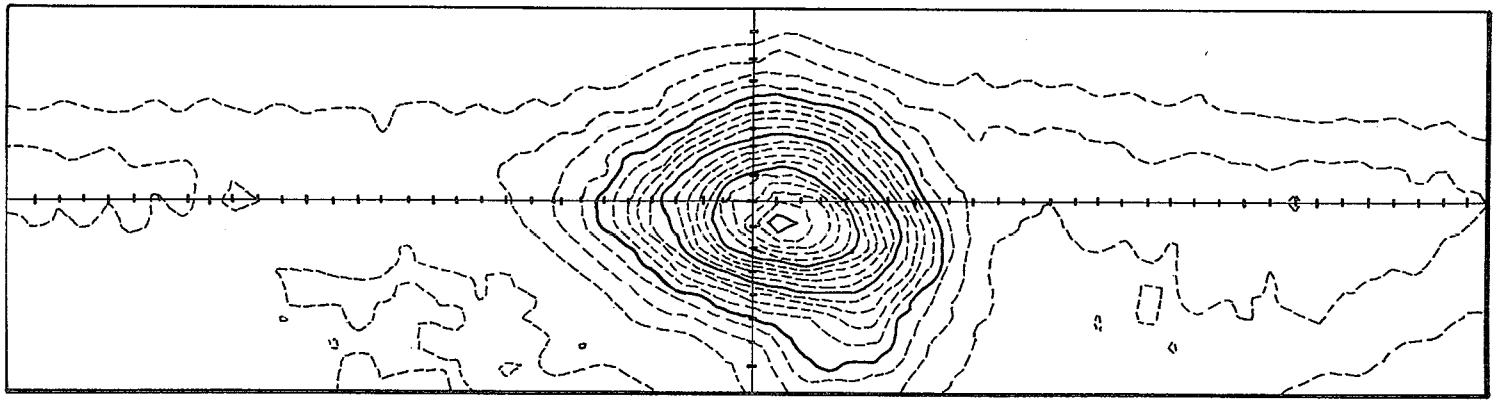
FIG. 8 is a candela diagram of a high beam pattern produced by a reflector in accordance with the present invention.

FIG. 7 shows a computer generated candela diagram of a light intensity pattern for a reflector designed by this process. FIG. 7 is the low beam pattern and FIG. 8 is the high beam pattern. In these diagrams the dashed lines are contours of 2000 candela and the solid lines are contour lines of 10,000 candela. That is, in FIG. 7, the contour line 45 represents 2,000 candela, the contour line 46 represents 24,000 candela and the contour lines in between are intervening candela values. Note in FIG. 7 that the beam pattern is shifted down and to the right as is required in automotive specifications. In the high beam pattern of FIG. 8 a wide high intensity beam is produced, shifted only slightly down into the right as is required by automotive specifications.

Appendix I lists, by way of example, a computer program which is suitable for performance on a Univac 1100/81 computer. This listing is provided only for aid in practicing the invention by programming and debugging a system which is suitable for the particular application. As with all computer programs it should not be assumed that the program will run without the usual debugging.

The program includes a number of subroutines which carry out the steps of FIG. 3 in the following manner.

ENV, step 34, models a tungsten halogen lamp. It writes the position and direction of a ray onto file 14. It models radiation from a cylinder with axial temperature distribution, then determines filament blocking, end cap blocking, and envelope refraction.

RUN, step 29, is the main program for optimization. It calls OPT2. NITER is the number of iterations which are run.

OPT2, steps 30 and 41, is a multivariate optimizer. It looks for the least value of the performance function PFUN with variation in the vector XNEXT. The optimizer compares performance indices for several sets of 8 coefficents and guesses at a better set. Repeating this process many times finds a local minimum of the performance index, giving the best set of coefficients for the given shape function. This subroutine attempts to minimize the performance function. OPT2 calls subroutine PFUN.

PFUN runs reflection and performance subroutines. It returns performance for some set of variables (DX in this case). To find shape, it would use S vector, not DX.

RAYR, step 38, models the reflection. It takes rays from file 14, finds intersections of the rays with the reflector, finds normal at intersection, distorts normal, finds reflected ray from distorted normal, then projects ray onto spheres 60 and 25 feet from reflector. Finally, it writes the intersection onto file 10.

ZVAL, step 28, describes the shape of the reflection surfaces. Given x, y, S, it returns z. A call to ZVAL takes a x- and y-coordinate along with 8 coefficents S and returns the Z value of the reflector. Multiple calls can therefore evaluate dz/dx and dz/dy and find the theoretical surface normal. Two off-axis ellipsoids with a blend area between are used but other shapes may be used.

The edge shape function Z1 is used on the intervals $-3.7''$ to $-1.45''$ and $1.45''$ to $3.7''$. This shape refects light from the lamp to the high intensity portion of the pattern. Three of the eight coefficients are used to vary this shape.

The center shape function Z2 is used on the interval $-1.2''$ to $1.2''$. It spreads light on a horizontal line across the screen. The remaining five coefficients control this shape.

On the intervals $-1.45''$ to $-1.2''$ and $1.2''$ to $1.45''$, the shape is a smooth blend between Z1 and Z2.

The functions are chosen arbitrarily to describe a general shape which the designer feels may give a good intensity distribution. The designer then chooses which coefficients to allow to vary. For instance, Z1 describes a paraboloid where S(7) is the horizontal angle between the primary axis and the screen center. The process of choosing functions is therefore trial and error. A function choice is put into ZVAL, and its resultant intensity distribution is found. If the designer likes what he sees, the coefficients are optimized. If not, he tries another shape.

NORM finds the unit surface normal at the intersection.

SCAT distorts the normal about NORM value with the gaussian distribution=SIG.

REFL finds the unit reflected ray given the incident ray and the distorted normal.

CD reads sphere intersections from file 10, finds candela values every $\frac{1}{2}°$ on $30° \times 8°$ section for both spheres. Filament power is set in line 1020(2W). If NRAY is less than 49000, cd values are averaged over $1\frac{1}{2}° \times 1\frac{1}{2}°$ area for each point.

PERF compares model cd values to SAE spec. Returns a performance index for the given configuration.

The values for the coefficient set which were used to produce the reflector of FIG. 2 are as follows:

S[1, . . . , 8]=[0.0814, 0.1730, 2.706, 0.07733, 0.2816, 1.6913, 1.9259, 0.16351]

While a particular embodiment has been shown and described with respect to automotive headlights, various modifications are within the true spirit and scope of the invention, since the invention is equally applicable to other lighting units such as dental lights, street lighting, and domestic and commercial lighting. The appended claims are, therefore, intended to cover all such modifications.

What is claimed is:

1. A digital computer aided process for producing a smooth, unfaceted reflector for a lighting unit having a prescribed light dispersion pattern comprising:

(a) digitizing said prescribed light pattern as an input to a digital computer;

(b) digitizing the parameters of a plurality of shape functions specifying the surface of said reflector as an input to said digital computer;

(c) tracing the path of a plurality of light rays emanating from a digitally modeled light source, intersecting said reflector and projecting onto a surface spaced apart from said reflector;

(d) determining the light intensity across said surface;

(e) comparing said light intensity to said prescribed light pattern;

(f) changing said parameters of said shape functions to meet said prescribed light pattern;

(g) repeating steps (c)–(f) in an iterative procedure to determine the shape function which produces a light intensity best matching said prescribed light pattern;

(h) at each change of said parameters, smoothing the junctions between said shape function so that they have a well-defined normal and a minimum radius of curvature greater than about 0.050 inches; and (i) fabricating reflectors having said shape function which produces a light intensity best matching said prescribed light pattern.

2. The process recited in claim 1 wherein the step of tracing includes:

determining the coordinates of the intersection of each light ray with said surface of said reflector;

determining the normal of the coordinates of said intersection;

projecting each ray path from said normal; and determining the coordinates of the intersection of each ray path with said surface.

3. The process recited in claims 1 or 2 wherein the step of determining the light intensity includes:

counting the number of light rays intersecting each unit area of said surface.

4. The process recited in claim 1 wherein said prescribed light pattern is specified as minimum and maximum intensitites at positions on said surface remote from said headlight and wherein the step of comparing includes:

dividing the counted number of ray paths intersecting each location by the total number of ray paths and comparing the quotient to the specified intensity at a corresponding location.

5. The process recited in claims 1 or 4 further comprising:

generating a performance function dependent upon the comparison of said light intensity to said prescribed light pattern and wherein the steps of said process are repeated to optimize said performance function.

6. The process recited in claim 1 wherein said digitally modeled light source includes a filament modeled by a hollow cylinder with a temperature distribution along its length.

7. The process recited in claims 1 or 6 wherein said digitally modeled light source includes a transparent envelope enclosing at least one filament.

8. The process recited in claim 7 wherein said transparent envelope is modeled as a glass cylinder with opaque end caps.

9. The process recited in claim 1 wherein said shape functions include a center modified ellipsoid and two edge modified ellipsoids.

10. The process recited in claims 1 or 9 wherein said shape functions are digitally modeled surfaces and wherein the step of changing said parameters includes modifying said digitally modeled shape functions to meet said prescribed light pattern and to produce smooth continuous junctions between said shape functions.

11. The process recited in claim 10 wherein light rays reflected from said junctions are traced.

12. The process recited in claim 1 further comprising:

digitally modeling said shape functions with smooth continuous junctions between them; and tracing the paths of light rays reflected from said junction.

13. The process recited in claim 2 further comprising:

varying said normal within prescribed limits to model distortion caused by forming inaccuracies.

14. A reflector for a sealed beam automotive headlight produced by the process of claims 1 or 12.

15. A digital computer aided process for producing a smooth, unfaceted reflector for a lighting unit having a prescribed light dispersion pattern and having a clear unfluted front cover comprising:

(a) digitizing said prescribed light pattern as an input to a digital computer;

(b) digitizing the parameters of a plurlity of shape functions specifying the surface of said reflector as an input to said digital computer, said shape functions including a center modified ellipsoid and two edge modified ellipsoids;

(c) tracing the path of a plurality of light rays emanating from a digitally modeled light source, intersecting said reflector and projecting onto a sphere surrounding said reflector;

(d) determining the light intensity across a surface of said sphere;

(e) comparing said light intensity to said prescribed light pattern;

(f) changing said parameters of said shape functions to meet said prescribed light pattern;

(g) repeating steps (c)–(f) in an iterative procedure to determine the shape function which produces a light intensity best matching said prescribed light pattern;

(h) at each change of said parameters, smoothing the junctions between said shape function so that they have a well-defined normal and a minimum radius of curvature greater than about 0.050 inches; and (i) fabricating reflectors having said shape function which produces a light intensity best matching said prescribed light pattern.

16. A lighting unit comprising:

a light source; and a reflector positioning said light source, said reflector having a reflective surface which directs light from said light source in a desired pattern, said surface being smooth and continuous and including a center modified ellipsoid and two edge modified ellipsoids, said ellipsoids being modified to direct light in said desired pattern and to produce smooth continuous junctions between said edge ellipsoids and said center ellipsoid, the junctions between reflective surfaces having a well defined normal and a minimum radius of curvature greater than about 0.050 inches.

17. The lighting unit recited in claim 16 and a clear, unfluted front cover attached thereto.

18. The lighting unit recited in claim 16 wherein said center ellipsoid is modified at the center thereof to include a smooth vertical bump, said ellipsoids being tilted off the axis of said lighting unit.

19. The lighting unit recited in claim 16 wherein said edge ellipsoids each have a vertically extending smooth junction with said center ellipsoid, said ellipsoids being concave surfaces.

20. The lighting unit recited in claims 16 or 17 wherein said reflective surface directs light in a pattern which meets specifications for automotive headlights to form a sealed beam automotive headlight.

21. The automotive headlight recited in claim 20 wherein said clear front cover has an aerodynamically desired angle with respect to said headlight.

22. The light unit recited in claim 16 wherein said minimum radius of curvature is greater than about 0.193 inch.

* * * * *